US006715519B1

(12) United States Patent
Battaglia

(10) Patent No.: US 6,715,519 B1
(45) Date of Patent: Apr. 6, 2004

(54) APPARATUS FOR FILLING FOOD TRAYS AT HIGH SPEEDS

(76) Inventor: John Battaglia, 78 McKinley St., Hackensack, NJ (US) 07601

( * ) Notice: Subject to any disclaimer, the term of this patent is extended or adjusted under 35 U.S.C. 154(b) by 0 days.

(21) Appl. No.: 10/064,308

(22) Filed: Jul. 1, 2002

(51) Int. Cl.[7] ..... B65B 3/00

(52) U.S. Cl. ..... 141/160; 141/1; 141/129; 141/153

(58) Field of Search ..... 141/1, 129, 130, 141/134, 135, 138–140, 153, 155–158, 160, 183, 188

(56) References Cited

U.S. PATENT DOCUMENTS 3,412,766 A * 11/1968 Anderson et al. ..... 141/161
3,648,741 A * 3/1972 Croasdale et al. ..... 141/9
4,457,348 A * 7/1984 Mueller et al. ..... 141/1

* cited by examiner

*Primary Examiner*—J. Casimer Jacyna
(74) *Attorney, Agent, or Firm*—Richard A. Joel, Esq.

(57) ABSTRACT

The invention comprises a compact high speed food depositor which includes a pump driven by a first servomotor to feed food product through tubing and a second servomotor rotating a cutoff nozzle mounted about the tubing to deposit a predetermined accurate amount of food product in a tray moving along a belt. A computer with a touch screen controls the servomotor and calculates the required weight deposit along with the speed and placement of food product in the trays.

14 Claims, 5 Drawing Sheets

APPARATUS FOR FILLING FOOD TRAYS AT HIGH SPEEDS

BACKGROUND OF INVENTION

The present invention relates to a computer-controlled apparatus and method for depositing foods/sauces into plastic trays that are moving at high speed using servomotors coupled to a computer.

To fill trays with food or sauces, a typical apparatus of the prior art generally requires three reciprocating cylinders to pump the food product to respective outlets and a carousel to move the three filling outlets over the trays at the same speed as the trays in order to fill the trays without leaking or spilling over the edges.

The prior art apparatus is large in size, requires complicated pneumatic control systems and complicated mechanical parts in order to operate. There is considerable maintenance involved with this equipment (down time), there are many parts to clean at the end of each production run and making weight deposit adjustments requires tools to set mechanical stops. Accuracy across all three cylinders tends to vary due to unique wear on each of the cylinders. This means that there is always the possibility of weight variation in each tray. Because the three cylinders are driven from one common source, adjusting weights is complicated. All of these issues combined add up to long setup times, usually requiring qualified maintenance personnel.

In the prior art, U.S. Pat. No. 5,906,297 to Cole discloses a multi outlet depositor that displaces first and second portions of material and includes first and second positive displacement vane pumps. The pumps are coupled together so that the volume of the first portion varies according to the volume of the second portion.

The state of the prior art is also shown in patents such as U.S. Pat. No. 6,212,861 to Tsuruta on a Forming, Filling and Sealing Machine for Standing Pouch and U.S. Pat. No. 6,058,680 to Meile, et al on a Method and Apparatus for Forming and Hermetically Sealing Slices of Food Items. Also of interest are U.S. Pat. Nos. 5,155,969 to Kue and 4,997,664 to Williams. The prior art fails to disclose an apparatus of the type disclosed herein which uses a single positive displacement gear pump driven by a servomotor, controlled by a computer via a user-friendly touch screen to feed food product to a stationary tube over the trays. The tube has a plastic cut-off nozzle that revolves around the tube outlet driven by a second servomotor.

SUMMARY OF INVENTION

The invention relates to an apparatus for filling food trays with foods or sauces as the trays move along a conveyor at high speeds of approximately 150 trays per minute.

The apparatus comprises a compact integral unit including a positive displacement gear pump for feeding the food product driven by a first servomotor and a cut-off nozzle driven by a second servomotor. The servomotor is capable of making rapid moves with extreme accuracy and repeatability. A computer controls the servomotors via a user-friendly touch screen. Weight control and adjustments are made "on the fly" by the line operator on the touch screen. The pump feeds product through a sanitary tube to a horizontal stationary tube, which has an opening on the side of the tube face down over the plastic trays. The stationary tube has a plastic cutoff nozzle that rotates about the opening to deposit a predetermined precise amount of food product into a series of fast moving trays. A second servomotor drives this plastic cut-off nozzle to open and close the feed to the trays. The computer calculates and deposits the required weight product in the trays. As further advantages, no pneumatics are involved and the apparatus is simple to maintain, clean and operate.

Accordingly, an object of this invention is to provide a new and improved method and a stationary compact apparatus for filling food trays at high speed.

Another object of this invention is to provide a new and improved method and apparatus for filling food trays using computer-controlled servomotors.

A further object of this invention is to provide a new and improved method and apparatus for depositing a predetermined precise amount of food product in trays on a moving conveyor by feeding the product to an outlet having a computer controlled servomotor opening and closing the nozzle.

A still further object of this invention is to provide a new and improved method and apparatus for filling food trays under control of a computer that calculates the desired weight deposit and adjusts a first and a second servomotor for the required speed and placement.

A more specific object of this invention is to provide a new and improved method and apparatus for filling food trays moving at high speed on a conveyor which includes a first and second servomotor controlled by a computer with a user friendly touch screen to feed food products to an outlet nozzle and deposit said product in accordance with a computer program for the particular product.

BRIEF DESCRIPTION OF DRAWINGS

The above and other objects of the invention may be more readily seen when viewing in conjunction with the accompanying drawings wherein.

FIGS. 4*a–c* is a view of the plastic tray with target zone dimensions showing respectively a top, side and end view of the trays; and.

DETAILED DESCRIPTION

Figure 1:
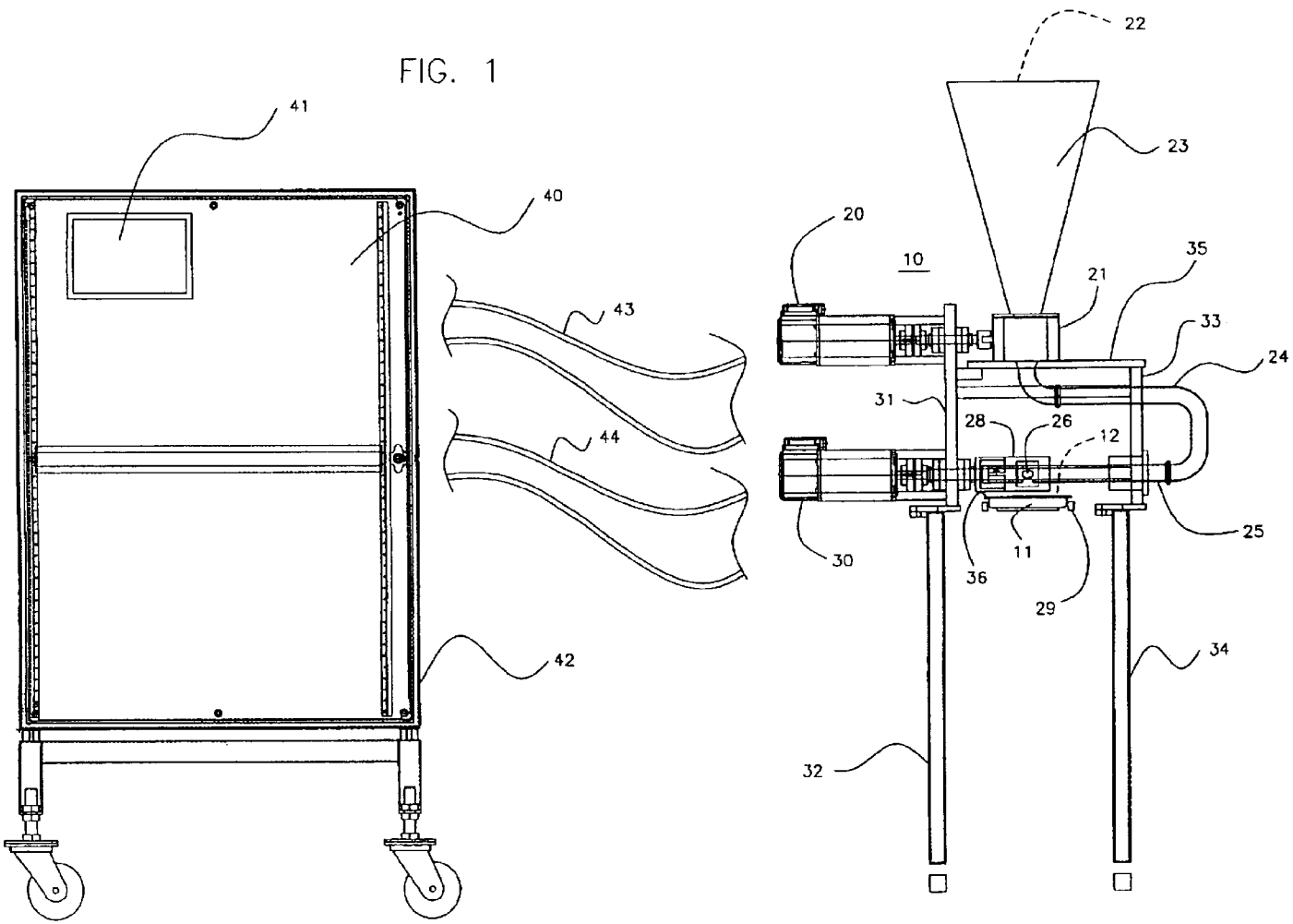
FIG. 1 is a front view of the invention.

Referring now to the drawings and particularly FIG. 1, the invention comprises an apparatus 10 for filling food trays 11 at high speed. The trays 11 each contain a pocket 12 into which a /deposit 13 is made at a speed ranging from 1 to 150 trays per minute with a typical speed being 125 trays per minute. The filling deposits 13 can be as low as 61 grams (2.18 oz) and as high as 288 grams (10.28 oz).

The apparatus 10 includes a first servomotor 20 connected to a positive displacement gear pump 21. The servomotor 20 is capable of making rapid moves with extreme accuracy and repeatability. Food product or sauces 22 are deposited into a hopper 23 and fed by pump 21 through a sanitary tube 24 to a horizontal stationary tube 25. The tube 25 has an opening 26 on its lower portion 27 over the plastic food trays 11.

The stationary tube 25 has a plastic cut-off nozzle 28 that rotates about the tube 25. The cut-off nozzle 28 is driven by a second servomotor 30 and includes two identical openings 29*a* and 29*b* that are located 180° apart. The cut-off nozzle 28 is set to rotate at the speed of the trays 11 passing under the nozzle 28. This creates a "nozzle following the trays" effect. Thus, the nozzle opens according to line speed that directionalizes the product 13 into the trays 11 without moving the filler.

A computer 40 with a user-friendly touch screen 41 controls both servomotors 20 and 30. The computer calculates the required weight deposit along with the speed and placement of the product 13.

The servomotors 20 and 30 are mounted to a vertically extending portion 31 of the supporting frame 32 while a second vertical member 33 on the frame 34 cooperates therewith to support horizontal pump support member 35. The trays 11 move on a conveyor 29 between the frame members 32 and 34 and the vertical member 31 and 33. The trays 11 maintain a specific center distance between adjacent trays 11. A sensor (not shown) determines when a tray 11 is missing and signals the computer 40 not to deposit food product 13.

The servomotor 30 rotates the cut-off nozzle 28 90° in order to stop and start flow through the tube opening 26 into the passing trays 11. Dripping across the rim 36 of a tray 11 is avoided by the precise operation of the servomotors 20 and 30. The typical belt speed for the trays is 78.8 feet per minute with the center distance from one tray to he next being 7.563".

The rotary valve or cutoff nozzle 28 has two nozzle openings 1 at 0° and 1 at 180°.

The nozzle position at 180° (closed) will move rapidly to 244° (open) in 0.2 seconds and will rotate 52° to 296° in 0.4 seconds. The gear pump 21 should have already stopped and reversed in a minimum time of 0.4 seconds. The rotary valve 28 then rapidly moves to 360° to receive the next signal. In an embodiment operating at a maximum speed of 150 trays per minute, there is a total of 0.8 seconds of allowed time, 0.4 seconds allowed to fill and 0.4 seconds allowed not to fill. The outlet of the nozzle is positioned two inches from the bottom of tray 11 or one inch from the top lip 36 of tray 11.

Figure 2:
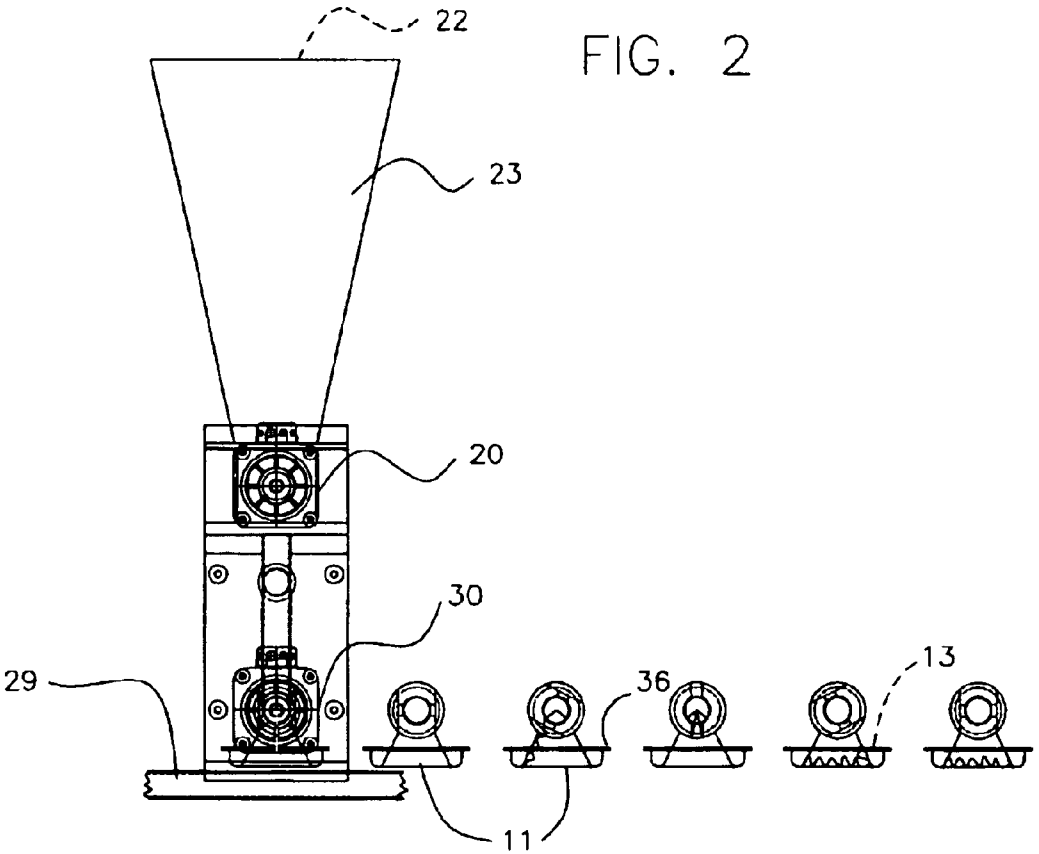
FIG. 2 is a is a schematic side view of the invention showing a plurality of plastic trays in motion and various nozzle positions associated with filling the trays.
Figure 3:
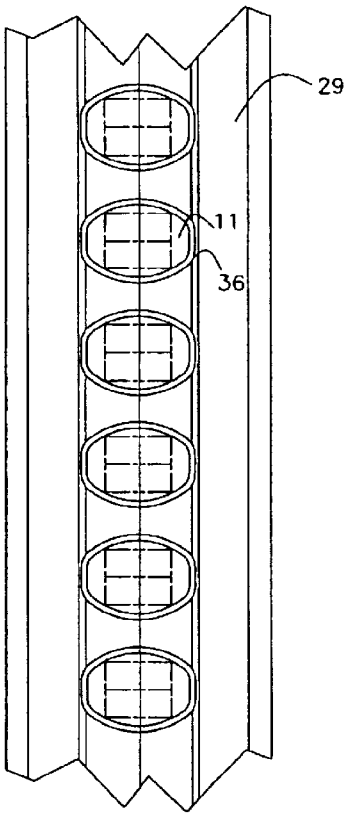
FIG. 3 is a partial top view showing the plastic trays on a conveyor.

FIG. 1 shows the computer 40 with the touch screen 41 positioned on a rolling cart 42 with cables 43 and 44 connecting the computer 40 to respective servomotors 20 and 30. FIG. 2 shows the plastic trays 11 in motion with nozzle positions above the trays 11. FIG. 3 is a top view of the oval trays 11 moving along the conveyor 29.

Figure 4A:
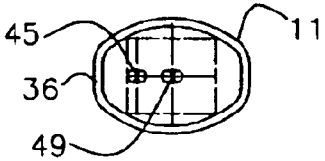
Figure 4B:
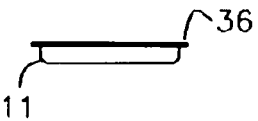
Figure 4C:
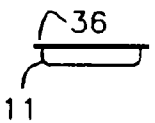
Figure 5:
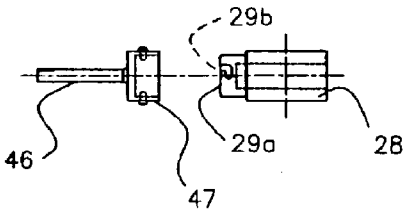
FIG. 5 is an exploded view of a servomotor drive shaft and cut off nozzle controlled by the servomotor.

FIGS. 4*a–c* shows the plastic oval tray 11 with target zone dimensions. If the tray 11 is to be filled with food product, the target is shown at 49 whereas if the tray 11 is to be half filled the target is at 45. FIG. 5 is an exploded view of the rotating cutoff nozzle 28 and the drive shaft 46 and coupling 47 of servomotor 30.

The apparatus 10 does not require compressed air for any pneumatics. As required by the FDA, the apparatus 10 is simple to maintain and clean and simple to operate. With the computer-controlled servomotors, recipes/programs for different products may be stored. For example, if the product of the day is macaroni and cheese with a 9-ounce deposit, the program can be stored by name, MACARONI & CHEESE 9OUNCE. When selected, the program will bring up all of the recorded settings. This makes setups easy for the line operator and skilled maintenance personnel are not required.

While the invention has been explained by a detailed description of certain specific embodiments, it is understood that various modifications and substitutions can be made in any of them within the scope of the appended claims, which are intended also to include equivalents of such embodiments.

What is claimed is:

1. An apparatus for filling trays moving on a belt with a food product comprises:

a first servomotor and a second servomotor electronically cammed together for precise in concert control;

a computer connected to the first and second servomotors to operate said servomotors in accordance with selected computer instructions;

a feed tube;

a food source and a pump connected to the first servomotor for forcing food through the feed tube;

a horizontal tube portion of the feed tube mounted over the belt having an opening opposite the belt; and, a cut-off nozzle mounted over the horizontal tube opening and having a pair of spaced openings connected to the second servomotor and rotatably driven thereby to rotate at the speed of the trays to deposit the desired amount of food product in a tray.

2. An apparatus for filling trays in accordance with claim 1 wherein: the pump is a positive displacement gear pump.

3. An apparatus for filling trays in accordance with claim 1 wherein: the food source is a hopper having an outlet connected to the pump input.

4. An apparatus for filling trays in accordance with claim 1 further including;

a sensor to determine when a tray is not present on the belt and signal the computer not to deposit food product through the cut-off nozzle.

5. An apparatus for filling trays in accordance with claim 1 wherein:

the pair of spaced openings in the cutoff nozzle are located at 180° apart.

6. An apparatus for filling trays in accordance with claim 1 wherein:

each tray includes a pocket within which the food product is deposited, said nozzle being adjustable to deposit the food product in the center of the tray to fill the tray to its maximum or on the side of tray if a partial fill is require.

7. An apparats for filling trays in accordance with claim 6 wherein:

a tray can be filled with food product ranging from 61 grams to 288 grams depending on tray size.

8. An apparatus for filling trays in accordance with claim 1 wherein:

the number of trays filled ranges from 1 to 150 per minute depending on tray size.

9. An apparatus for filling trays in accordance with claim 1 wherein:

the apparatus is compact and stationary and the nozzle opens according to tray speed to directionalize the food product into a tray without moving the feed tube.

10. The method of filling trays with food product comprising the step of:

moving the trays along a conveyor at high speed;

driving a filling pump with a first servomotor;

pumping the food product to a stationary tube mounted above the moving trays and having an opening therein;

rotating a cut-off nozzle with a second servomotor to deposit a predetermined amount of food product in each tray; and, controlling the first and second servomotors with a computer.

11. An apparatus for filling trays moving on a belt with a food product comprising:

a first servomotor and a second servomotor electronically cammed together for precise in concert control;

a computer connected to the first and second servomotors to operate said servomotors in accordance with selected computer instructions and wherein the computer includes a touch screen for providing instructions to the servomotors;

a feed tube;

a food source and a pump connected to the first servomotor for forcing food through the feed tube;

a horizontal tube portion of the feed tube mounted over the belt having an opening opposite the belt; and, a cut-off nozzle mounted over the horizontal tube opening and having a pair of spaced openings connected to the second servomotor and rotatably driven thereby to rotate at the speed of the trays to deposit the desired amount of food product in a tray.

12. An apparatus for filling trays in accordance with claim 11 wherein:

the computer stores recipe/programs for different products that can be recalled by touch to affect a setting for a particular food product.

13. An apparatus for filling trays in accordance with claim 11 wherein:

the computer calculates and provides the required weight deposit along with the speed and placement of the deposit on the tray.

14. An apparatus for filling trays in accordance with claim 11 wherein:

the computer is portably mounted adjacent the servomotors.

* * * * *